US008720588B2

(12) United States Patent
Schilte et al.

(10) Patent No.: US 8,720,588 B2
(45) Date of Patent: May 13, 2014

(54) METHOD AND SYSTEM FOR FIXING AN ELEMENT IN A BOREHOLE

(75) Inventors: Paul Dirk Schilte, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 441 days.

(21) Appl. No.: 13/130,325

(22) PCT Filed: Nov. 24, 2009

(86) PCT No.: PCT/EP2009/065769

§ 371 (c)(1), (2), (4) Date: May 20, 2011

(87) PCT Pub. No.: WO2010/058033

PCT Pub. Date: May 27, 2010

(65) Prior Publication Data

US 2011/0220370 A1 Sep. 15, 2011

(30) Foreign Application Priority Data

Nov. 24, 2008 (EP) ..... 08169781

(51) Int. Cl.
*E21B 23/01* (2006.01)

(52) U.S. Cl.
USPC ..... 166/381; 166/387; 166/179

(58) Field of Classification Search
USPC ..... 166/381, 387, 66, 179
See application file for complete search history.

(56) References Cited

U.S. PATENT DOCUMENTS

| | | | | |
|---|---|---|---|---|
| 4,174,577 | A | 11/1979 | Lewis | 33/302 |
| 6,206,133 | B1 | 3/2001 | Paulsson | 181/102 |
| 6,230,800 | B1 | 5/2001 | Bryant | 166/250.01 |
| 6,386,044 | B1 | 5/2002 | Weinmann | 73/784 |
| 7,814,973 | B2 * | 10/2010 | Dusterhoft et al. | 166/227 |
| 2004/0065443 | A1 | 4/2004 | Berg et al. | 166/380 |
| 2005/0199401 | A1 * | 9/2005 | Patel et al. | 166/387 |
| 2007/0151724 | A1 | 7/2007 | Ohmer et al. | 166/187 |
| 2011/0315377 | A1 * | 12/2011 | Rioufol | 166/250.17 |
| 2012/0055669 | A1 * | 3/2012 | Levin et al. | 166/250.17 |

FOREIGN PATENT DOCUMENTS

| | | | |
|---|---|---|---|
| GB | 2411918 | 9/2005 | E21B 33/10 |
| WO | WO2007034242 | 3/2007 | E21B 17/20 |

* cited by examiner

*Primary Examiner* — Giovanna Wright

(57) ABSTRACT

A method is provided of fixing at least one element, preferably a sensor or a valve, in a borehole formed in an earth formation. The method comprises positioning each element in the borehole, positioning a swellable body in the borehole, the swellable body being susceptible of swelling upon contact with a swell fluid, wherein the swellable body is arranged to press the element against a wall of the borehole upon swelling of the swellable body, and allowing the swell fluid to contact the swellable body thereby inducing the swellable body to swell and to press the element against said wall of the borehole.

15 Claims, 4 Drawing Sheets

METHOD AND SYSTEM FOR FIXING AN ELEMENT IN A BOREHOLE

CROSS REFERENCE TO EARLIER APPLICATIONS

The present application is a national stage application of International application No. PCT/EP2009/065769, filed 24 Nov. 2009, which claims priority of EP08169781.5 filed in the European patent office on 24 Nov. 2008 and incorporated herein by reference.

FIELD OF THE INVENTION

The present invention relates to a method and system for fixing an element in a borehole formed in an earth formation.

BACKGROUND OF THE INVENTION

There is an increasing interest in applying devices for exploring the subsurface of the earth in a permanent or semi-permanent setting at respectively the earth's surface (which is herein intended to encompass any land surface or surface below a volume of water, for instance the seabed), above the earth formation of interest, for instance a reservoir containing hydrocarbon fluids (natural gas and/or oil). The devices are anchored at the surface or seabed and may provide a continuous stream of measurement data, which for instance can be used to monitor how the reservoir is depleted and which parts of a field need special attention to increase the overall recovery of the hydrocarbons.

An example of a device for exploring the subsurface is a geophone that converts seismic waves reflected from the formations in the subsurface into an electrical signal. Another example is a hydrophone that is a submersible device for converting the seismic waves reflected by the subsurface geology and causing pressure variations in the water into similar electrical signals.

While the geophones and hydrophones used to be placed at the surface of the land or at the seabed, it is believed that placing the geophones and hydrophones below the earth surface, for instance 30 m or deeper below surface, may cause the quality of the measured seismic data to improve markedly. The poor quality of the seismic signals measured at the surface may be caused by the influence of surface noise and acoustically poorly defined top soils. This influence is not present or less so in seismic signals measured sufficiently below the surface of the earth.

A geophone normally comprises one or more transducers for converting the vibrations in one or more directions into corresponding electrical signals. The transducers are placed in a housing and further includes support means, such as a base, ground plate, a spike of gimbal for supporting the housing in an operative position with respect to the earth's surface. However, for obvious reasons it is difficult to properly arrange geophones with such support means at a position below the earth surface. If for instance horizontal boreholes are made in the subsurface and the geophones (or hydrophones) are to be placed in the boreholes, the geophones cannot be fixed to the earth in the usual way. One may be able to lower the geophones into the borehole, but arranging them at exactly the right positions and fixing them to the wall of the hole or to the casing provided inside the borehole turns out to be difficult if not impossible. If the geophones can neither be properly positioned in the borehole nor be firmly fixed to the borehole, this may have an adverse influence on the signal to noise ratio of the geophones.

SUMMARY OF THE INVENTION

It is an object of the present invention to provide a method and system for properly arranging at least one element in a borehole formed in an earth formation.

In accordance with the invention there is provided a method of fixing at least one element, preferably a sensor or a valve, in a borehole formed in an earth formation, the method comprising:

positioning each element in the borehole;

positioning a swellable body in the borehole, the swellable body being susceptible of swelling upon contact with a swell fluid, wherein the swellable body is arranged to press the element against a wall of the borehole upon swelling of the swellable body; and allowing the swell fluid to contact the swellable body thereby inducing the swellable body to swell and to press the element against said wall of the borehole.

Under influence of the swell fluid, that is the formation fluid and/or the fluid introduced by the operator from the surface into the borehole, the swellable body expands in such a way that the elements are fixed inside the borehole. By making use of swellable bodies it is relatively easy to properly fix the elements to the wall of the (casing of) the borehole so that during operation the elements may be kept stationary at selected positions along the borehole. Furthermore, the swellable bodies may be construed and arranged so as to firmly press the elements against the wall of the borehole or against the casing of the borehole. If the element is a sensor and the sensor is pressed firmly against the formation (i.e. the borehole wall or the casing), the signal to noise ration of the sensor may improve considerably.

Any elements (tools, devices, sensors, valves etc.) can be fixed in place in open hole or cased boreholes using the method according to the present invention. No pre-installed seats or receptacles are required and the element with swellable body will be tolerant for variations in geometry (hole size).

To avoid the swellable bodies to swell when the elements are being inserted into the borehole and to generally facilitate their insertion into the borehole, preferably said at least one element comprises a plurality of elements arranged in a cartridge, and wherein each element is positioned in the borehole by positioning the cartridge in the borehole, the method further comprises removing the elements from the cartridge while retrieving the cartridge from the borehole so as to arrange the elements at selected positions in the borehole.

During the insertion operation the elements may be accommodated in the cartridge and the elements are only removed during the retrieval of the cartridge from the borehole. In an embodiment wherein the elements are accommodated in a fluid-tight cartridge, the swellable elements are not exposed to any fluid inside the borehole, or are enclosed in a non-swelling fluid, and therefore will not swell before the elements are removed from the cartridge.

Suitably said elements are interconnected by connection means so as to form a string of said elements, and wherein the step of removing the elements from the cartridge comprises removing a first one of said elements from the cartridge and anchoring the first element in the borehole, and subsequently removing the remaining elements from the cartridge by retrieving the cartridge from the borehole.

In this embodiment the elements are arranged in a string of elements, for instance by attaching the elements at predetermined mutual distances to a cable or the like. When the first element, at the distal end of the string, is removed from the cartridge, it should be fixed to the wall or casing of the borehole. This can be achieved by swelling the swellable body until it presses the element against the borehole. However, it may take a while before the elements are pressed sufficiently firm against the borehole to establish a strong anchoring of the element to the formation. The first element is therefore anchored to the borehole by means of one or more anchors that are described hereafter.

The step of positioning the cartridge in the borehole suitably comprises attaching the cartridge to a pipe, preferably a drill pipe or coiled tubing, and running the pipe into the borehole. This enables the cartridge to be run in and pulled out of the borehole easily and using readily available equipment. The pipe to which the cartridge is attached may be a drill pipe or coiled tubing. Coiled tubing requires less effort to trip in and out of the borehole while the coil can be simply run in and pulled out while a drill string must be assembled and disassembled joint by joint while tripping in and out. However, a drill string may be run deeper into a horizontal borehole.

Advantageously the step of retrieving the cartridge comprises pulling the pipe out of the borehole, and releasing the elements at predetermined mutual distances in the borehole.

The elements are released and then fixed at suitable mutual distances by swelling the swellable bodies of the elements.

In some cases it is required or at least preferred to arrange the elements in a predefined orientation inside the borehole. For instance, for good functioning of a vibration sensor, for instance a geophone or hydrophone, one of the sensor parts, for instance one of the sides of the housing thereof, should be placed in a predefined orientation relative to the formation and pressed against the borehole. One preferred way of achieving this is by providing each element with a floating member arranged to induce the element to move to a selected orientation in a body of liquid present in the borehole whereby the element floats on said liquid so as to move the element to said selected orientation.

The liquid present in the borehole can be formation fluid originating from the formation surrounding the borehole. Alternatively or additionally the operator may pump fluid into the borehole. Important is that the elements are able to float on the fluid inside the borehole so that the element is turned under the influence of gravity into a selected orientation. The downward facing side may be a side that is pressed against the wall of the borehole, for instance in the horizontal sections of shallow boreholes. However, in other embodiments of the invention other sides of the element may be pressed against the wall of the borehole.

wherein the swellable body is adapted to de-swell upon contact with a de-swell fluid, and wherein the method further comprises introducing the de-swell fluid into the borehole so as to induce de-swelling of the swellable body, and removing the element from the borehole.

If the elements, for instance sensors or valves, need to be retrieved, for instance for repair or inspection, the elements may be removed by de-swelling the swellable bodies of the elements. Assuming it was formation water that caused the swelling, a de-swell fluid, for instance a high salinity brine, could be pumped into the borehole and the swellable body should be soaked for several days or weeks. This will result in osmotically bound water in the elastomer to be released, and de-swelling will occur. Alternatively, the body could have been of the oil-swelling kind and oil could have been used as swelling fluid. After swelling, the oil can be replaced by (formation) water, if needed, or it may happen as a matter of course. This will have no relevant effect on the swelling of the body. To de-swell the body, it should be soaked in heavy oil, which will cause the lighter oil to be released from the body and de-swelling occurs.

In a preferred embodiment the swellable element is an elastomeric element, wherein the elastomer is of a type that expands when it contacts one or more specific fluids. In a further embodiment the elastomer is of a type that will expand when in contact with a first (swell) fluid, for instance light oil, and will shrink when in contact with a second (de-swell) fluid, for instance heavy oil.

According to another aspect of the present invention there is provided a system for fixing at least one element, preferably a sensor or a valve, in a borehole formed in an earth formation, comprising:

means for positioning each element in the borehole;

means for positioning a swellable body in the borehole, the swellable body being susceptible of swelling upon contact with a swell fluid, wherein the swellable body is arranged to move the element against a wall of the borehole upon swelling of the swellable body; and means for allowing the swell fluid to contact the swellable body thereby inducing the swellable body to swell and to move the element against said wall of the borehole.

As mentioned before, suitably said at least one element comprises a plurality of elements arranged in a cartridge positioned in the borehole, the elements being removable from the cartridge by retrieving the cartridge from the borehole so as to arrange the elements at selected positions in the borehole. For example, the elements may be interconnected by connection means so as to form a string of said elements, the system further comprising anchoring means for anchoring a first one of said elements in the borehole, and wherein the cartridge is construed so as to release the elements from the cartridge while the cartridge is retrieved from the borehole so as to arrange the elements at mutual distances in the borehole.

The cartridge may be easily inserted into the borehole if the cartridge is attached to a pipe, preferably a drill pipe or coiled tubing, the pipe being adapted to be run into the borehole.

To properly orient each element in the borehole, suitably the element is provided with a floating member arranged to induce the element to move to a selected orientation in a body of liquid present in the borehole whereby the element floats on said liquid so as to move the element to said selected orientation.

If the element needs to be retrieved from the borehole, the swellable body may be adapted to de-swell upon contact with a de-swell fluid, and the system may further comprise means for introducing the de-swell fluid into the borehole so as to induce de-swelling of the swellable body, and to allow the element to be removed from the borehole.

BRIEF DESCRIPTION OF THE DRAWINGS

Further advantages, characteristics and details of the present invention will become apparent from the following description of preferred embodiments thereof. In the description reference is made to the annexed drawings in which.

The detailed description set forth below in connection with the appended drawings is intended as a description of the presently preferred embodiments of the invention, and is not intended to represent the only form in which the present invention may be practiced. It is to be understood that the same or equivalent functions may be accomplished by different embodiments that are intended to be encompassed within the scope of the present invention.

DETAILED DESCRIPTION OF THE INVENTION

Figure 1:
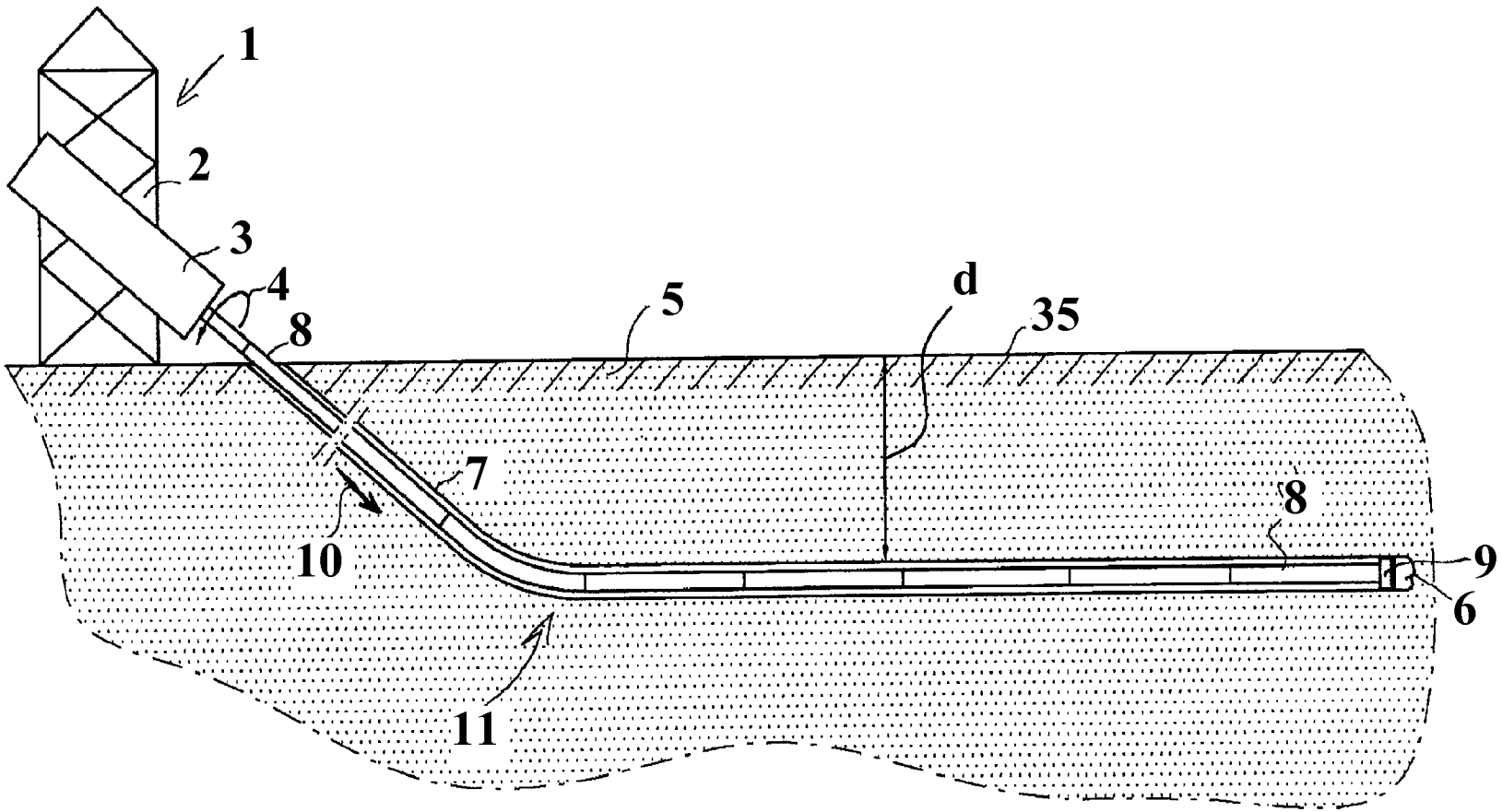
FIG. 1 shows a schematic longitudinal section of a drilling arrangement for drilling a horizontal borehole in a subsurface, the arrangement being provided with an embodiment of the system according to the present invention.

FIGS. 1-5 show an example of a low-angle borehole 6 (for instance a wellbore) formed in the subsurface 5, which includes an earth formation layer containing saline formation water. Shown is a surface drilling system 1 employing a drilling rig as for providing the borehole in the earth. It will be appreciated that an offshore drilling system may likewise employ the current invention. Drilling system 1 comprises a drilling rig 2 that is used to support drilling operations. Many of the components needed for the drilling operations are not shown for ease of description. As depicted in FIG. 1, the borehole 6 has already been partly drilled and the drilling operation is carried out by a rotary table or top drive 3 that causes rotation (direction 4) and translation (direction 10) of a number of consecutive pipe segments 8 provided with a drill bit 9 at the distal end thereof. The rotation of the pipe segments causes the drill bit 9 to rotate. Instead of, or in addition to, rotating the drill bit 9 by using a rotary table or top drive 3 at the surface, the drill bit may be turned by a downhole drive motor (not shown), powered by the motion of drilling fluid pumped from the surface through the drill string. Hereafter the combination of pipe segments 8 and drill bit 9 will be referred to as the drill string 11.

It will also be appreciated that instead of using a number of pipe segments 8 that must be assembled and de-assembled joint by joint while tripping them in and out the borehole, coiled tubing may be employed. Coiled tubing involves a long metal piping spooled on a large drum. Using coiled tubing has the advantage that the piping can simply be run in and pulled out of the borehole by turning the drum without having to assemble or disassemble parts of the piping.

It is to be understood that other horizontal drilling systems may be appropriate in the particular circumstances or that the boreholes are made by other techniques, such as pipe jacking, horizontal directional drilling (HDD or any other suitable techniques for trench less installation of boreholes in the earth. It is to be appreciated that all these and other techniques may be employed in the present invention.

As used herein, the term "borehole" may be any hole formed in the earth formation and may include, but is not limited to, a wellbore that has been drilled for purposes of hydrocarbon production. The borehole may be an open hole or a cased hole, and no pre-installed seats or receptacles are required (but still may be present).

In the embodiment shown, the horizontal directional drilling is made to level out at a particular depth (d) below the earth surface 35. The depth d may vary depending on the actual geological situation or the purpose of the hole. In case of seismic sensors the horizontal portion of the borehole is positioned below earth layers having seismic characteristics affected by surface conditions, for instance the weathering layer of the subsurface.

After the drilling system 1 has drilled the borehole 6 into the subsurface, the drill string 11 is retrieved from the borehole. After retrieval of the drill string 11, the drill bit 9 is replaced by a cartridge 32 according to an embodiment of the present invention. The cartridge includes a housing having an interior space 33 wherein a plurality of elements 12 may be placed. The diametrical size of the cartridge is selected such that sufficient space remains between the cartridge and the borehole wall for flow of fluid. Although in the following description the elements 12 are sensors, more specifically hydrophones, that measure the pressure and/or shear waves that are induced in the subsurface by one or more seismic sources, any other type of element may be employed in the present invention. In the shown embodiment the cartridge 32 contains six sensors 12. It will be appreciated that the actual number of sensors might vary, depending on the situation.

In an embodiment the sensors 12 are arranged in a row. In a further embodiment the sensors are arranged in string comprising a plurality of sensors connected by a connecting element. In the embodiment shown in FIG. 2 the sensors 12 are interconnected by one or more cables 13 extending to the surface and carrying one or more communication lines forming a communication path between each of the downhole sensors and equipment stationed at the surface.

Figure 2:
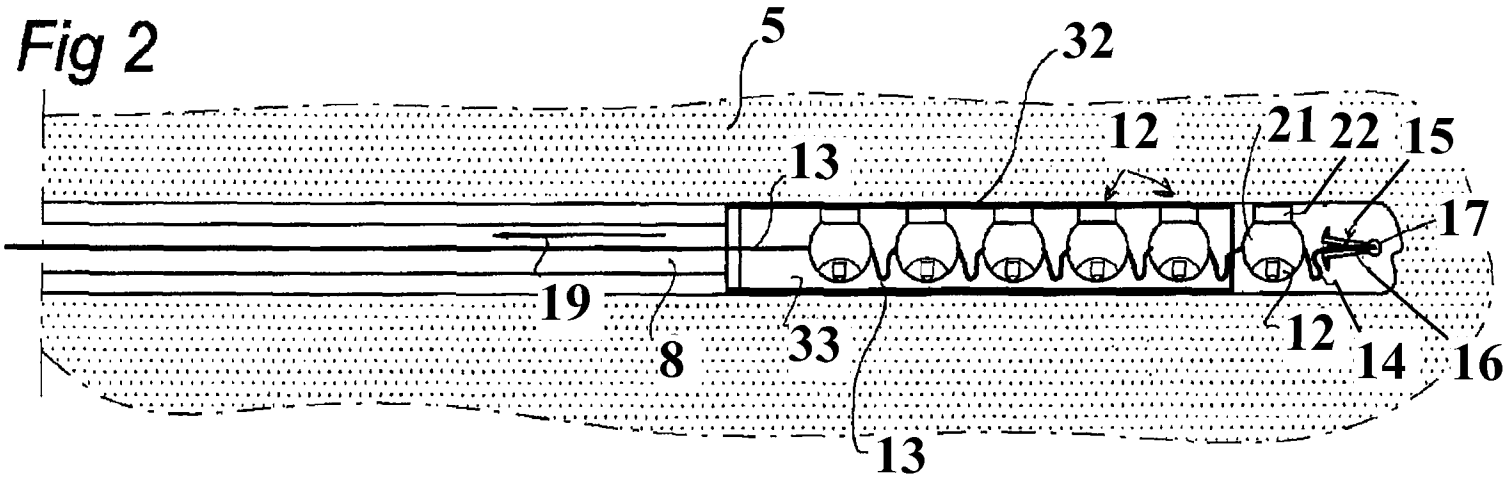
FIG. 2 shows a more detailed longitudinal section of an embodiment of a cartridge provided with a plurality of sensors, with a first sensor released from the cartridge.

The cartridge 32 is introduced in the borehole 6 and translated by the drill string 11 to the horizontal portion of the borehole. Once the cartridge 32 has reached the region where the sensors 12 are to be placed, the cartridge 32 is pulled back while the sensors 12 are released from the cartridge 32, as is illustrated in FIG. 2. While the cartridge is moved into the borehole, the sensors 12 in the interior space 33 thereof may be protected from any fluids present inside the borehole 6. When, however, the first sensor 12' has been released in a borehole, it may get into contact with fluid present inside the borehole 6.

The sensor 12 comprises a sensor housing 21 (cf. FIG. 6), having an outer surface that is provided with a body 22 for fixing the housing to the wall of the borehole 6. The body 22 is attached to one portion of the outer surface and is configured to expand (swell) when it is in contact with a specific fluid. By placing the swellable body 22 at the proper portion of the housing, the housing 21, as a result of the expansion (direction 23 in FIG. 6) of the body, is pressed against the wall 26 of the borehole 6. The swellable body 22 is therefore able to fix the sensor at a predefined position to the walls of the borehole.

Several materials may be suitable for the purposes of fixing sensors to the surrounding formation. The swellable body comprises in an embodiment of the invention a matrix material provided with a compound soluble in a fluid, for instance formation water, wherein the matrix material prevents or restricts migration of the compound out of the swellable body by osmosis so as to induce swelling of the swellable body upon migration of this fluid into the swellable body. One example of a suitable matrix material is a polymer matrix material, for example a thermoset elastomer matrix material or a thermoplastic elastomer matrix material. Further examples of suitable materials are disclosed in EP 1 649 136 A1, which document is incorporated herein by reference.

Since the time it takes for the swellable body 22 to swell sufficiently as to press the sensor 12 firmly against the wall 26 of the borehole, the distal sensor 12' is provided with a spring-loaded end anchor 15. The anchor comprises a series of spring-loaded arms, and forms an end cap of the cartridge 32 containing the sensors. The spring-loaded arms are kept in retracted position by the housing of the cartridge. When the housing reaches the target depth for release of the anchor, a pressure pulse is applied from surface causing the anchor to move out of the housing whereby the arms contact the borehole wall and activate the anchor.

Figure 3:
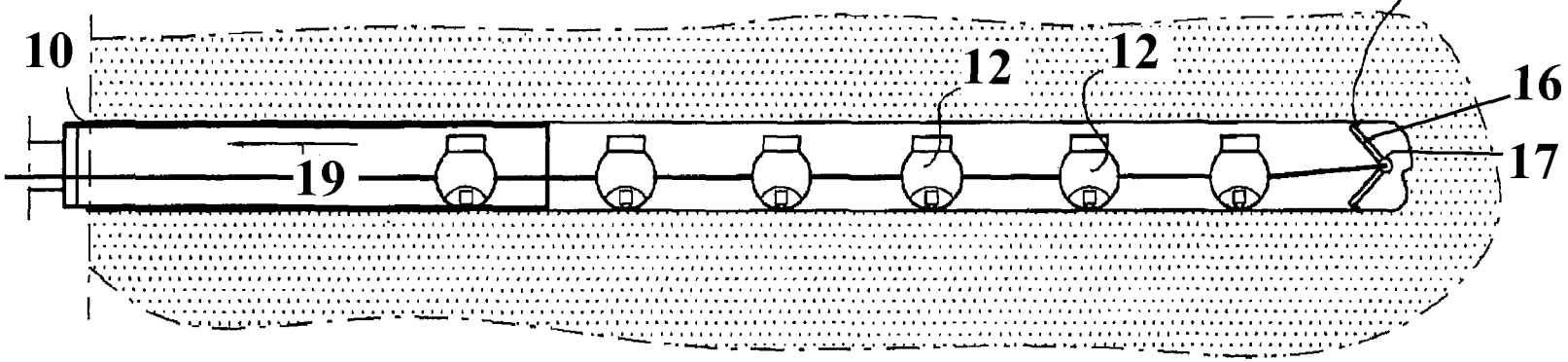
FIG. 3 shows the section of FIG. 2, when several more sensors have been released from the cartridge.
Figure 4:
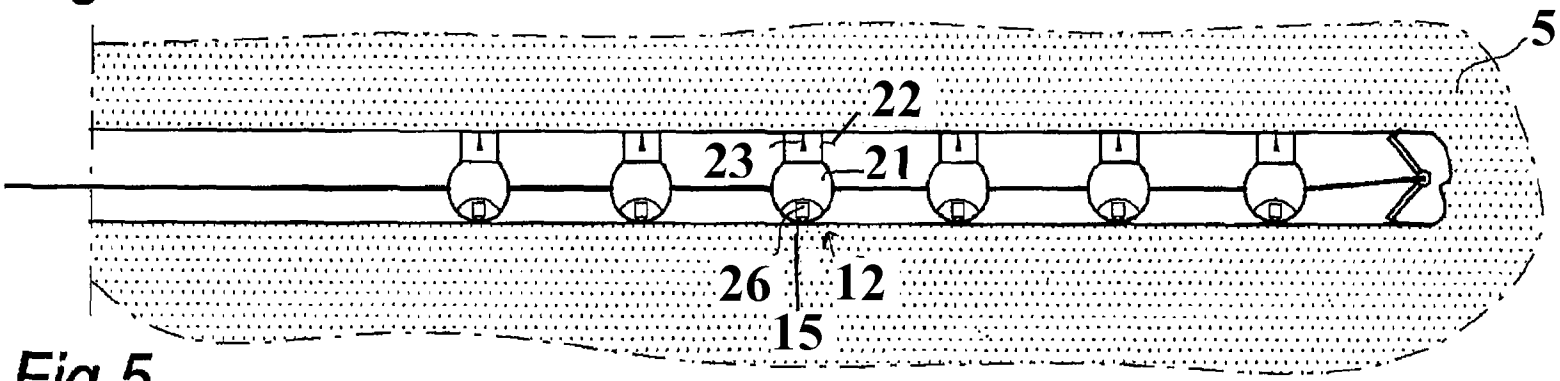
FIG. 4 shows the section of FIGS. 2 and 3, when all sensors have been released from the cartridge.

Anchor 15 is connected with a wire 14 to the distal sensor 12' and comprises two legs 14 joined by a pivot 17. At the free ends opposite to the pivot 17 the legs 16 are provided with sharp hooks 18. The spring urges the anchor 15 from a standby position shown in FIG. 2, into the anchoring position shown in FIG. 3. When the cartridge is retrieved (direction denoted by arrow 19 in FIG. 2), the distal sensor 12' will and subsequent sensors 12 being interconnected by cable 13, are pulled out of the cartridge and positioned at predefined positions in the borehole. This situation is shown in FIGS. 3 and 4.

Figure 5:
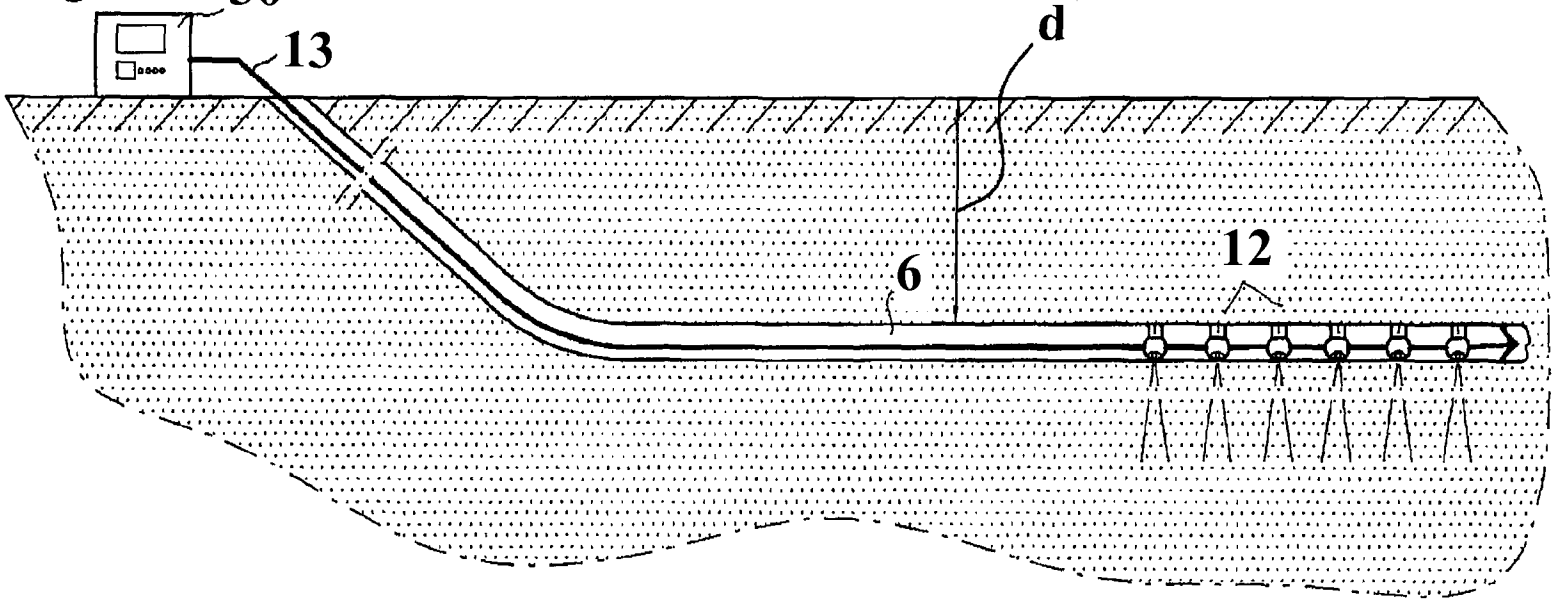
FIG. 5 shows the section according to any of FIGS. 2-4, wherein the sensors are actively exploring the geological composition of the formations below the borehole.

The positions of the sensors 12 depend on the length of the portions of the cable 13 interconnecting the sensors. In the figures the sensors are placed at equidistant positions, but in other embodiments (not shown), any mutual arrangement of the sensors is conceivable. When the cartridge 10 is further retrieved, it may be removed completely from the borehole, as is shown in FIG. 5. The communication lines may be connected to a receiving station 30 located collecting the measurement data from the sensors 12.

Figure 6:
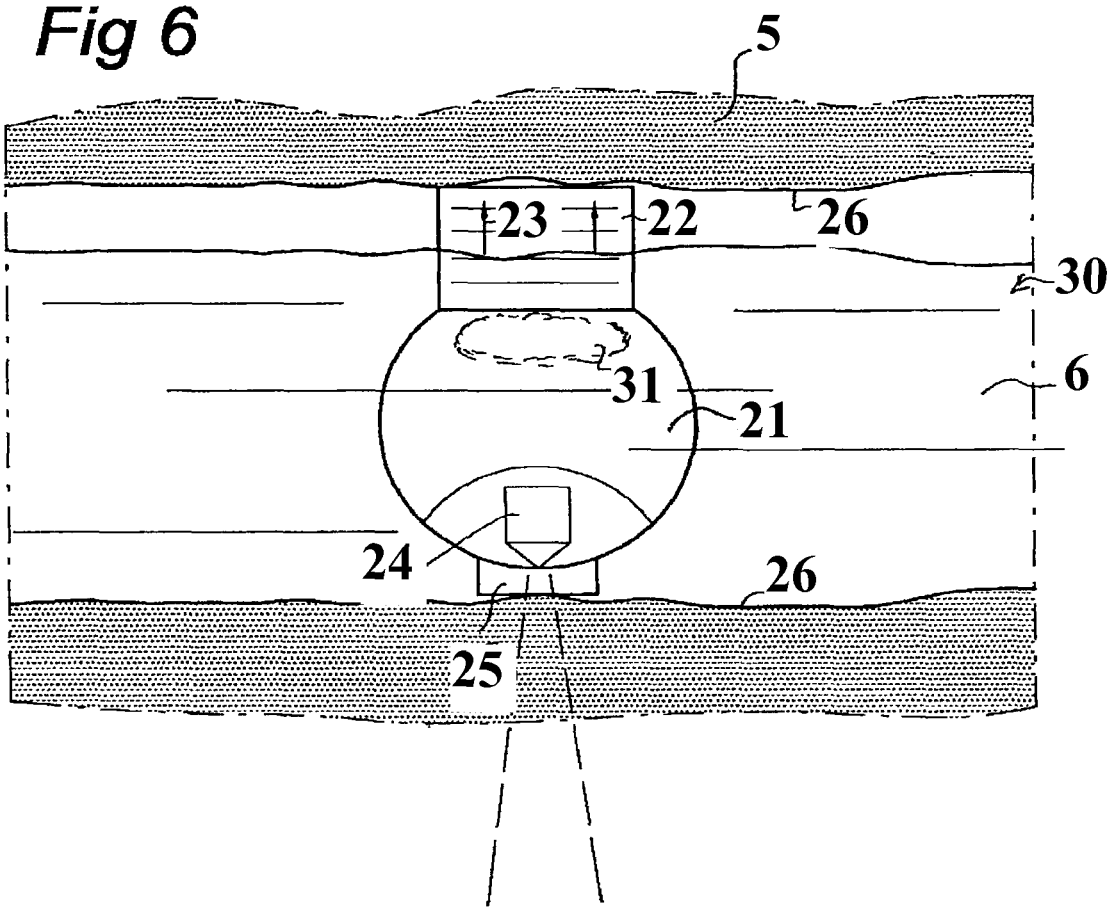
FIG. 6 shows a cross-section of an embodiment of a sensor in accordance with the present invention.

In the situation shown in FIG. 6 each of the sensors 12 is pressed strongly against the lower portion of the borehole wall 26. The borehole wall is, in the situation shown in FIG. 1, the casing 7 but in the situation shown in FIGS. 2-5, the sensors are pressed against the wall of the formation surrounding the borehole 6. Furthermore, the borehole has been depicted as a cylindrical hole having a constant diameter, however in practice the shape and size of the borehole may vary considerably. In an embodiment of the present invention, the maximum expansion of the swellable body is larger than the variation of the diameter of the borehole, so that the sensors 12 may be fixed at any position inside the borehole, independent from the local diameter of the borehole.

Each of the sensors 12 is provided with a transducer 24 (only shown schematically in FIGS. 2-6) for converting vibrations in the formation into corresponding electrical signals. In order for the transducers to accurately sense the vibrations in the formation, the transducers 24 are provided with a contact area 25 that is to be pressed tightly onto the wall 26 of the borehole. The swellable body 22 is arranged on the opposite side of the housing 21 of the sensor 12. It is important to ensure that the contact area 25 always faces downward, so that it can be pressed firmly against the bottom part of the borehole. The proper orientation of the sensor 12 is caused by a floating element 31 that is embedded inside the housing 21 of the sensor. The floating element 31 is arranged in the upper portion of the housing 21. The housing floats on the fluid 30 (FIG. 6) present inside the borehole in such a manner, that the area 25 faces downward and the swellable body 22 faces upward. When the swellable body 22 expands under the influence of the fluid inside the borehole, the sensor, in this case the hydrophone, will be prompted towards the lower side of the borehole 6 and the sensor will always touch the wall of the borehole at the contact area 25.

If the sensors 12 need to be retrieved from the borehole 6, for instance for inspection or repair operations, the string (comprising the sensors 12 and the cable 13) can be retrieved by de-swelling the respective swellable bodies 22. Assuming it was formation water that caused the swelling of the swellable body, a high salinity brine could be pumped into the borehole 6 and the swellable body can be soaked for a predetermined time interval, for instance several days or weeks, but this will result in the osmotic bound water in the swellable body to be released and the body will shrink (de-swelling will occur). When the swellable body has been reduced in size sufficiently, the sensors 12 are no longer fixed to the wall of the borehole and can be easily removed from the borehole In another embodiment the swellable body 22 is configured so as to swells under the influence of light oil. This may be oil from a nearby formation, but can also be pumped into the borehole from the surface of the earth. After swelling, the oil can be replaced by another fluid, for instance formation water, if needed, by pumping the oil from the borehole or the removal of the oil can happen as a matter of course. In this embodiment the presence of (formation) fluid has no substantial effect on the swelling of the body 22 and therefore the sensors 12 remain fixed to the formation. To de-swell the swellable body 22, it can be soaked with heavy oil, which causes the light oil to be released from the body and therefore de-swelling of the body 22

In the embodiment wherein an anchoring device 15 is used, additional means can be used to remove the anchoring device from the wall of the borehole. For example, the anchoring device can be equipped with a shear device that provides a weak point in the wire or cable 14 between the anchoring device and the distal hydrophone 12. After applying sufficient tension to the wire the weak point will fail and the hydrophones 12 can be removed from the borehole.

In the shown examples of the hydrophone according to the present invention the swellable (and possible de-swellable) material of the body 22 is arranged at one side of the housing of the sensor, while the transducer is arranged close to the opposite side of the housing, so that the contact surface that is to be pressed against the formation is also positioned opposite to the swellable body 22.

Although the invention has been described with reference to specific embodiments thereof, it will be appreciated that invention is not limited to these embodiments and that changes and modifications to the system and method described herein may be made without departing from the invention.

Instead of using a drilling rig having an inclined orientation of the rotary table, as schematically depicted in FIG. 1, a conventional drilling rig having a vertical orientation of the rotary table or top drive can be used.

Furthermore, the borehole in which the element(s) is (are) to be arranged, can be a horizontal or inclined side-track borehole section of an existing observation borehole or production borehole.

We claim:

1. A method of fixing at least one element in a borehole formed in an earth formation, the method comprising:

positioning each element in the borehole;

positioning a swellable body in the borehole, the swellable body being susceptible of swelling upon contact with a swell fluid, wherein the swellable body is arranged to press the element against a wall of the borehole upon swelling of the swellable body; and allowing the swell fluid to contact the swellable body thereby inducing the swellable body to swell and to press the element against said wall of the borehole, wherein said at least one element comprises a plurality of elements arranged in a cartridge, and wherein each element is positioned in the borehole by positioning the cartridge in the borehole, the method further comprises removing the elements from the cartridge while retrieving the cartridge from the borehole so as to arrange the elements at selected positions in the borehole.

2. The method of claim 1, wherein said elements are interconnected by connection means so as to form a string of said elements, and wherein the step of removing the elements from the cartridge comprises removing a first one of said elements from the cartridge and anchoring the first element in the borehole, and subsequently removing the remaining elements from the cartridge by retrieving the cartridge from the borehole.

3. The method of claim 1, wherein the step of positioning the cartridge in the borehole comprises attaching the cartridge to a pipe and running the pipe into the borehole.

4. The method of claim 3, wherein retrieving the cartridge comprises pulling the pipe out of the borehole, and releasing the elements at predetermined mutual distances in the borehole.

5. The method of claim 1, wherein each element is provided with a floating member arranged to induce the element to move to a selected orientation in a body of liquid present in the borehole whereby the element floats on said liquid so as to move the element to said selected orientation.

6. The method of claim 1, wherein the swellable body is adapted to de-swell upon contact with a de-swell fluid, and wherein the method further comprises introducing the de-swell fluid into the borehole so as to induce de-swelling of the swellable body, and removing the element from the borehole.

7. The method of claim 1 wherein the swellable body is an elastomeric body.

8. The method of claim 1 wherein the swell fluid comprises formation fluid.

9. The method of claim 1, wherein said at least one element comprises a housing having an outer surface that is provided with the swellable body.

10. A system for fixing at least one element in a borehole formed in an earth formation, comprising:

means for positioning each element in the borehole;

means for positioning a swellable body in the borehole, the swellable body being susceptible of swelling upon contact with a swell fluid, wherein the swellable body is arranged to move the element against a wall of the borehole upon swelling of the swellable body; and means for allowing the swell fluid to contact the swellable body thereby inducing the swellable body to swell and to move the element against said wall of the borehole, wherein said at least one element comprises a plurality of elements arranged in a cartridge positioned in the borehole, the elements being removable from the cartridge by retrieving the cartridge from the borehole so as to arrange the elements at selected positions in the borehole.

11. The system of claim 10, wherein said elements are interconnected by connection means so as to form a string of said elements, the system further comprising anchoring means for anchoring a first one of said elements in the borehole, and wherein the cartridge is construed so as to release the elements from the cartridge while the cartridge is retrieved from the borehole so as to arrange the elements at mutual distances in the borehole.

12. The system of claim 10, wherein the cartridge is attached to a pipe, the pipe being adapted to be run into the borehole.

13. The system of claim 10, wherein each element is provided with a floating member arranged to induce the element to move to a selected orientation in a body of liquid present in the borehole whereby the element floats on said liquid so as to move the element to said selected orientation.

14. The system of claim 10, wherein the swellable body is adapted to de-swell upon contact with a de-swell fluid, the system further comprising means for introducing the de-swell fluid into the borehole so as to induce de-swelling of the swellable body, and to allow the element to be removed from the borehole.

15. The system of claim 10, wherein said at least one element comprises a housing having an outer surface that is provided with the swellable body.

* * * * *